US005353997A

United States Patent [19]

Kasseck et al.

[11] Patent Number: 5,353,997

[45] Date of Patent: Oct. 11, 1994

[54] PROCESS FOR CRUSHING RAW LIGNITE

[75] Inventors: Klaus Kasseck, Korschenbroich; Werner Karpus, Neuss; Gerhard Salewski, Essen, all of Fed. Rep. of Germany

[73] Assignee: Loesche GmbH, Korschenbroich, Fed. Rep. of Germany

[21] Appl. No.: 91,835

[22] Filed: Jul. 13, 1993

[30] Foreign Application Priority Data

Jul. 14, 1992 [DE] Fed. Rep. of Germany ..... 4223151

[51] Int. Cl.[5] ..... B02C 21/00; B02C 23/30

[52] U.S. Cl. ..... 241/17; 241/19

[58] Field of Search ..... 241/17, 18, 19, 23, 241/24

[56] References Cited

U.S. PATENT DOCUMENTS 2,909,330 10/1959 Hardinge ..... 241/19
4,817,441 4/1989 Porowski et al. ..... 241/19 X
4,932,594 6/1990 Kim ..... 241/19

FOREIGN PATENT DOCUMENTS 3734359 10/1987 Fed. Rep. of Germany .

*Primary Examiner*—Timothy V. Eley
*Attorney, Agent, or Firm*—Keck, Mahin & Cate

[57] ABSTRACT

The invention relates to a process for crushing raw lignite. The raw lignite is dried with an exit temperature after drying of approximately 70° to 85° C. The dried raw lignite is then crushed. This crushing of the dried raw lignite is performed in an air-swept roller mill, in which the crushing and cooling of the lignite particles is brought about by the inflowing cold and/or ambient air to a temperature range of below 60° C.

11 Claims, 2 Drawing Sheets

PROCESS FOR CRUSHING RAW LIGNITE

BACKGROUND OF THE INVENTION

The present invention relates to a process for crushing or pulverizing raw lignite or brown coal to fine coal.

For the pulverizing or normally moist raw brown coal to fine coal hitherto the brown coal has been passed through driers, in which e.g. an indirect steam heating of the coal has taken place and in this way the moisture has largely been removed from the coal. The raw lignite normally leaves such driers at a temperature of 70° to 85° C.

As these relatively high temperatures of 70° to 85° C. are extremely problematical with respect to an ignition or explosion of the coal dust mixture, the maximum permitted temperature for lignite dust has been set at 60° C. in order to exclude the aforementioned hazards.

As a result of the starting temperature following the drying of the lignite of 70° to 85° C., the dried raw lignite is cooled to a temperature of approximately 40° C. and this e.g. takes place in air-cooled drag chain conveyors.

The thus dried and cooled raw lignite has hitherto been comminuted and ground in continuous mills with crushing means, which are in particular in the form of rods or balls. In the case of these continuous mills e.g. designed as vibratory or agitator ball mills the comminution of the raw lignite mainly takes place between the crushing means and the crushing chamber wall. In said continuous mills as a result of the friction between the individual crushing means and between the crushing means and the crushing chamber wall heat is generated, which can lead to a marked temperature rise of e.g. 20° C. in the dried raw lignite. The previously cooled raw lignite consequently again reaches the permitted temperature limit of approximately 60° C.

In this hitherto used process it has proved to be particularly disadvantageous that the continuous mills used have a capacity limit of approximately 10 t/h with regard to the lignite throughout. Therefore in order to obtain a raw lignite throughput of approximately 60 t/h, as a function of the product fineness, it has hitherto been necessary to use six to ten such continuous mills, which in the preceding stages e.g. require four driers for the raw lignite with following the same four air-cooled drag chain conveyors.

Thus, the higher throughput capacity of a plurality of such units with a correspondingly larger number of drives, supply and discharge equipments, foundations, building with sound insulation and a higher monitoring and control expenditure.

However, it was necessary for the previously used process to limit the temperature of the raw lignite upstream of the mills to max. 40° C., which could only be achieved by additional cooling units with a correspondingly high investment expenditure, space requirements and consequently transportation, control and maintenance costs.

SUMMARY OF THE INVENTION

One object of the invention is consequently a process which, compared with the hitherto conventional process, for the same throughput requires lower costs.

Another object is to achieve quality improvements in the crushing process and in the conveying of the crushed product.

The process according to the invention for the crushing or pulverizing of raw brown coal or lignite to fine coal provides for a drying of the raw lignite with a raw lignite exit temperature after drying of approximately 70° to 85° C. and the linking of the following crushing process of the dried raw lignite with the cooling process under the critical temperature limit of 60° C. and for this purpose in particular an air-swept roller mill is suitable.

Such an air-swept roller mill, e.g. of the LOESCHE type, has a rotary grinding pan or bowl and crushing rollers thereon driven by frictional resistance by means of the product to be crushed, or provided with their own drive. Around the grinding pan edge is provided an all-round blade ring, through which the air flow is sucked or blown at high speed and angular momentum component into the grinding or crushing chamber. The comminuted material thrown from the grinding or crushing pan is engaged by the air flow in the roughly hollow cylindrical, outer annulus and guided in a rotary fluidized bed to the sifter or classifier positioned above the crushing chamber.

According to the invention cold gas and in particular cold or ambient air is sucked or blown into the crushing chamber by means of the blade ring and by intimately flowing round the raw lignite particles e.g. having a temperature of approximately 80° C. achieves a cooling of said particles during the rotation of the fluidized bed of the dust-air mixture upwards to the classifier. The flow rate and cold air throughput can also be regulated as a function of the feed of raw lignite to be crushed in such a way that the critical temperature limit of 60° C. of the lignite particles leaving the air-swept roller mill and classifier is not exceeded.

The preferred air-swept roller mill type for this process has a minimum spacing between the crushing means, i.e. the crushing pan and crushing rollers, so that a direct metallic contact leading to high frictional heat is avoided.

The subsequent classification of the lignite particles supplied to the classifier in a rising, rotary fluidized bed ensures a high constancy of the fine particle spectrum independently of partial or full load operation.

In addition, through the inflowing cold gas or cold air this can be simultaneously used as a feed medium for passing on the crushed and classified material to intermediate silos or consumers.

The process integration of an air-swept roller mill for the crushing of raw lignite and also other raw coal types permits particularly high throughputs, because said air-swept roller mills can be constructed in larger units and can e.g. replace six to ten known vibratory mills.

In addition, in said roller mills frictional heat through direct contact between the grinding or crushing parts is avoided. This can e.g. be brought about by mechanical spacers for the crushing rollers with respect to the crushing pans.

As the cold air flow in such an air-swept roller mill can be sucked from the atmosphere, there is no need to cool the dried raw lignite from 70° to 85° C. to approximately 40° C., which leads to considerable cooling unit cost savings.

Since according to the process of the invention an air-swept roller mill is used in place of six to ten vibratory mills, the overall apparatus expenditure and subsequent costs are considerably reduced.

A further advantage is obtained by operating the air-swept roller mill under vacuum, so that the cooling processes and the pneumatic conveying within the mill are more efficient and energy-saving. For the preferably chosen vacuum operation, which is also referred to as suction operation, the corresponding fans are positioned behind the air-swept roller mill and in particular behind the dust separators following the classifier. As a result of the suction action of said fans there is no temperature rise in the interior of the air-swept roller mill, so that the cooling action therein is maintained.

The main field of use of the process is the crushing or pulverizing of raw lignite. However, other raw coal types can be very economically crushed by means of the process in the manner described hereinbefore.

The invention is described in greater detail hereinafter relative to an embodiment.

DETAILED DESCRIPTION OF THE PREFERRED EMBODIMENT

Figure 1:
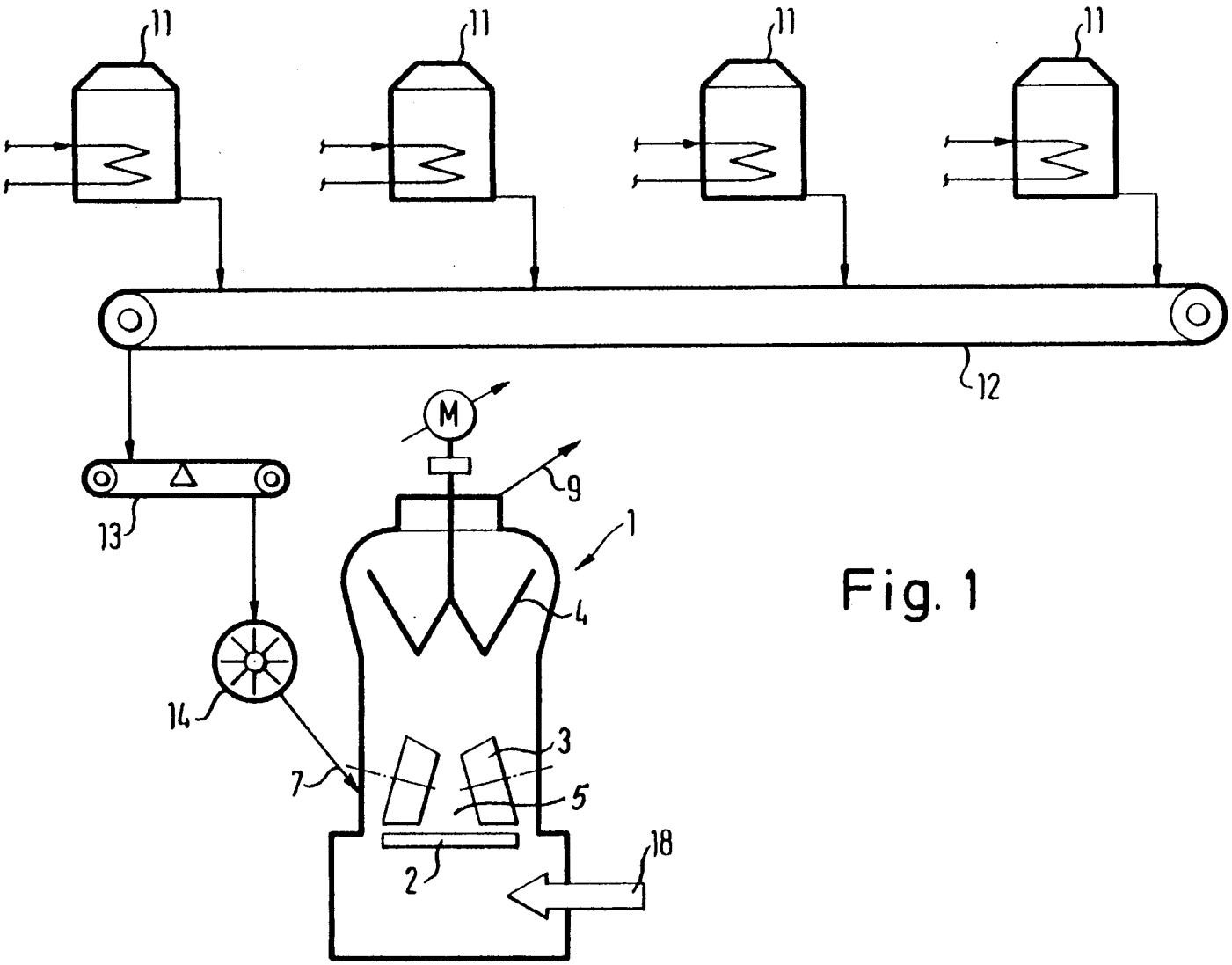
FIG. 1 is a diagrammatic representation of the process with the essential units.

FIG. 1 shows an air-swept roller mill 1, which has a driven, rotary crushing pan 2 and crushing rollers 3 rolling by frictional resistance or driven in a separate manner. Above the crushing chamber 5 there is a classifier 4 integrated into the casing of the air-swept roller mill 1.

The normally moist raw lignite is initially passed over driers 11, which can e.g. be rotary driers with indirect steam heating and is dried therein. The raw lignite passes at a temperature of approximately 70° to 85° C. out of said driers 11 on a conveyor 12 and then onto a weighing belt 13 for the metered delivery of the dried raw lignite. By means of a bucket wheel lock 14 and a supply means 7 the raw lignite is introduced into the air-swept roller mill 1.

A cold gas 18, particularly cold air from the atmosphere, is passed into the lower area of the roller mill 1 and enters the crushing chamber 5.

Figure 2:
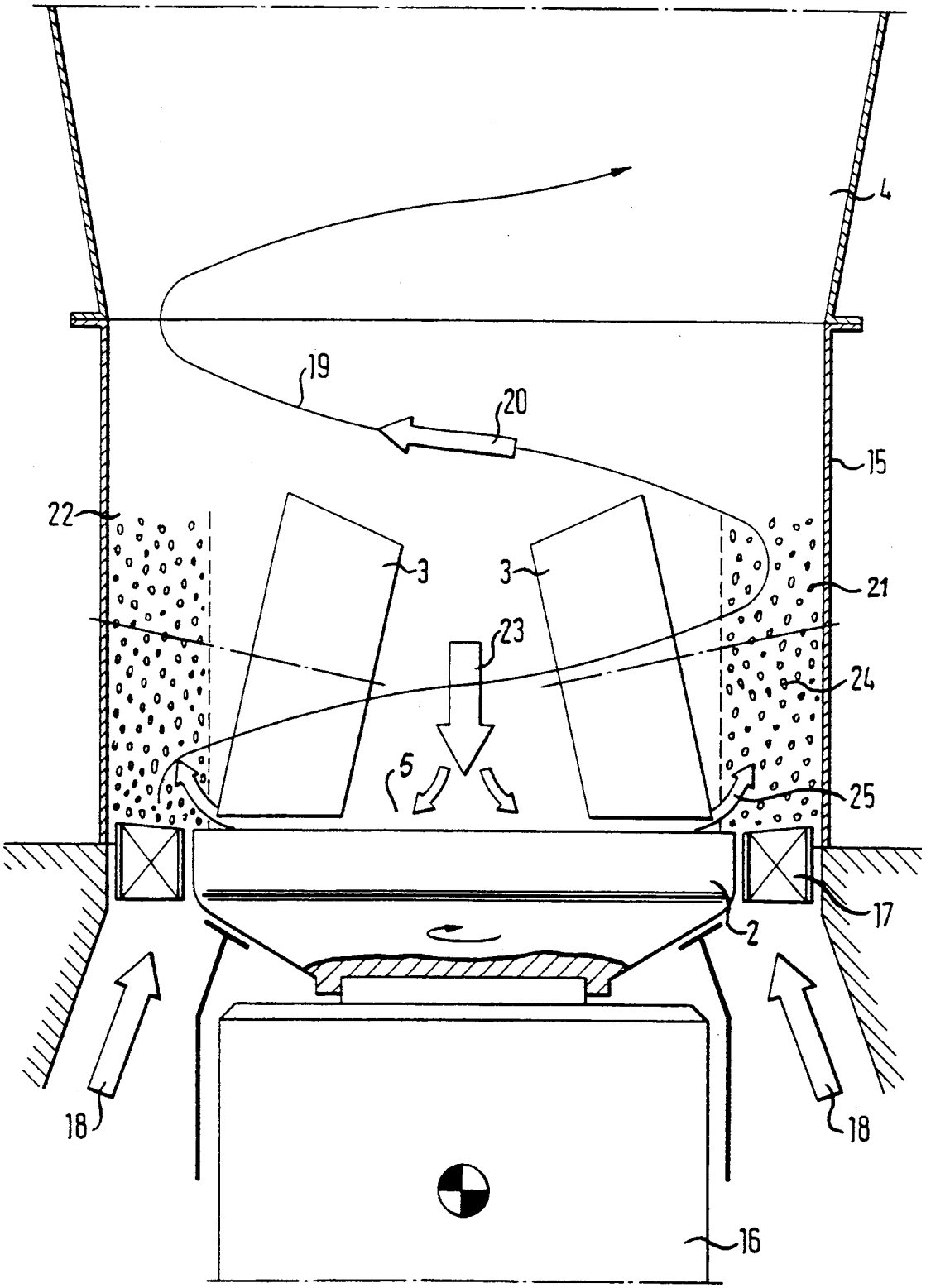
FIG. 2 is a larger scale view of a detail through the grinding or crushing area of the air-swept roller mill according to FIG. 1 with the essential flow conditions.

FIG. 2 is a larger-scale, diagrammatic partial view of the crushing chamber 5 of the roller mill 1. The cold air 18 in the marginal area of the crushing pan 2, which is rotated by means of a drive 16, is blown upwards into the crushing chamber 5 with an angular momentum by means of a blade ring 17. In an outer, hollow cylindrical annulus 22 an intimate flow occurs between the cold air 18 and the crushed raw lignite particles 21. The formation of a rotary, rising fluidized bed 24 of cold air 18 and crushed raw lignite particles 21 leads to a cooling of the particles to below the critical limit of 60° C.

The raw lignite 23 is passed roughly centrally onto the rotating crushing pan 2 and passes radially outwards through centrifugal force and is then comminuted and crushed under the pressure of the crushing rollers 3. The lignite particles 21 thrown out in the direction of the arrow 25 are then effectively cooled in the rotary fluidized bed 24 by contact with the cold air 18. This cooling process is regulated by the flow rate of the cold air and its temperature.

The rotary fluidized bed 24 rising in the direction of arrow 20 and which forms between the casing 15 and the edge of the crushing pan 2, is produced by the blade inclination of the blade ring 17 and the resulting annular momentum of the bed flow 19. The coal or lignite particles around which the cold air flows from all sides in this fluidized bed give off their heat to the cold air until at the coal dust outlet 9 from the classifier 4 integrated into the roller mill 1 a temperature below 60° C. is reached (FIG. 1). The classifier 4 also makes it possible that independently of partial or full load operation the fines leaving the classifier 4 by the outlet 9 can be set to a high constancy of a desired dust particle spectrum.

The cold air 18 used can simultaneously be used in advantageous manner for the pneumatic conveying of the fines to intermediate silos or to consumers.

What we claim is:

1. Process for crushing raw lignite to fine coal in an air-swept roller mill, comprising:

supplying previously dried raw lignite to an air-swept roller mill having a temperature of approximately 70° to 85° C.;

blowing cold air and/or air at ambient temperature through the air-swept roller mill;

crushing the dried raw lignite to form lignite particles at the same time as cooling the particles with the cold air and/or ambient air to a temperature below 60° C., and controlling the cooling of the lignite particles by controlling inflow speed and/or temperature of the cold air and/or ambient air.

2. Process according to claim 1, further comprising controlling cooling of the lignite particles during the crushing process by controlling the inflow speed of the cold air and/or ambient air in the range of 40 to 80 m/second.

3. Process according to claim 1, comprising forming an air-dust mixture of the cold air and/or ambient air and the lignite particles and supplying the air-dust mixture to a classification process.

4. Process according to claim 3, further comprising classifying the air-dust mixture in a classifier integrated with the air-swept roller mill.

5. Process according to claim 3, comprising operating the air-swept roller mill in a vacuum range.

6. Process according to claim 3, comprising setting the classification of the lignite particles to a desired size of particles independently of full or partial load operation.

7. Process according to claim 1, comprising pneumatically conveying the crushed and cooled lignite particles in silos.

8. Process according to claim 1, comprising forming a rotary fluidized bed of cold air and/or ambient air and lignite particles for cooling the lignite particles to below 60° C. in an outer annulus of the air-swept roller mill which comprises a crushing pan, crushing rollers and a blade ring.

9. Process according to claim 8, comprising forming the fluidized bed by blowing a spiral flow of cold air and/or ambient air through the blade ring surrounding the crushing pan.

10. Process according to claim 8, comprising carrying out the cooling and crushing of the raw lignite into lignite particles while maintaining a set spacing between the crushing pan and crushing rollers.

11. Process according to claim 10, wherein the spacing is set to a minimum which avoids direct metallic contact between the crushing pan and crushing rollers.

* * * * *

UNITED STATES PATENT AND TRADEMARK OFFICE

CERTIFICATE OF CORRECTION

PATENT NO. : 5,353,997

DATED : October 11, 1994

INVENTOR(S) : Klaus KASSECK et al.

It is certified that error appears in the above-identified patent and that said Letters Patent is hereby corrected as shown below:

On the title page, item

[73] The Assignee should read --Loesche GmbH, Düsseldorf, Fed. Rep. of Germany--.

Signed and Sealed this

Eleventh Day of April, 1995

*Attest:*

*Attesting Officer*

BRUCE LEHMAN

*Commissioner of Patents and Trademarks*